United States Patent [19]

Gee et al.

[11] 4,230,350

[45] Oct. 28, 1980

[54] OVEN DOOR LATCH

[75] Inventors: James W. Gee; Richard J. Arntz, both of Cleveland, Tenn.

[73] Assignee: Magic Chef, Inc., Cleveland, Tenn.

[21] Appl. No.: 27,446

[22] Filed: Apr. 5, 1979

[51] Int. Cl.[2] ..... E05C 1/06

[52] U.S. Cl. ..... 292/144; 292/342; 292/341.15; 292/DIG. 69

[58] Field of Search ..... 292/144, 342, 341.15, 292/241, 246, 343, DIG. 69, DIG. 44

[56] References Cited

U.S. PATENT DOCUMENTS

| | | | |
|---|---|---|---|
| 430,349 | 6/1890 | Munger | 292/246 X |
| 490,209 | 1/1893 | Morrell | 292/246 |
| 1,194,080 | 8/1916 | Schaum | 292/342 |
| 1,976,913 | 10/1934 | Beauchamp | 292/342 X |

*Primary Examiner*—Richard E. Moore

*Attorney, Agent, or Firm*—Bacon & Thomas

[57] ABSTRACT

A wedge-shaped bolt, slidable along an edge of an oven door opening engages a roller keeper on an oven door to force the door to tightly closed position and hold a door seal under compression. The roller keeper is resiliently mounted on the oven door seal.

4 Claims, 2 Drawing Figures

OVEN DOOR LATCH

BACKGROUND OF THE INVENTION

This invention relates to latching means for holding oven doors securely closed.

The provision of simple, relatively inexpensive and reliable latching means for oven doors has long presented a problem. This is particularly true in ranges wherein the oven is a self-cleaning oven by virtue of having high temperatures present therein for a substantial period of time. Under those conditions, it is imperative that the oven door be securely latched and held in a tight-sealing relation to the oven door opening.

SUMMARY OF THE INVENTION

The present invention embodies a door latching mechanism wherein a bolt is slidable along the range frame adjacent the oven door opening and along one edge thereof. The nose or leading end of the bolt is wedge-shaped and has a level portion at the rear of the wedge. When the bolt is slid forwardly, the wedge portion engages under a roller keeper carried by the door and urges the same inwardly up the inclined plane of the wedge and displaces the roller inwardly. The keeper is resiliently mounted on the oven door to yieldably move inwardly under the influence of the wedge-shaped bolt, and exert a resilient pressure toward the range and against the sealing means between the oven door and the range itself.

DESCRIPTION OF THE PREFERRED EMBODIMENT

Figure 1:
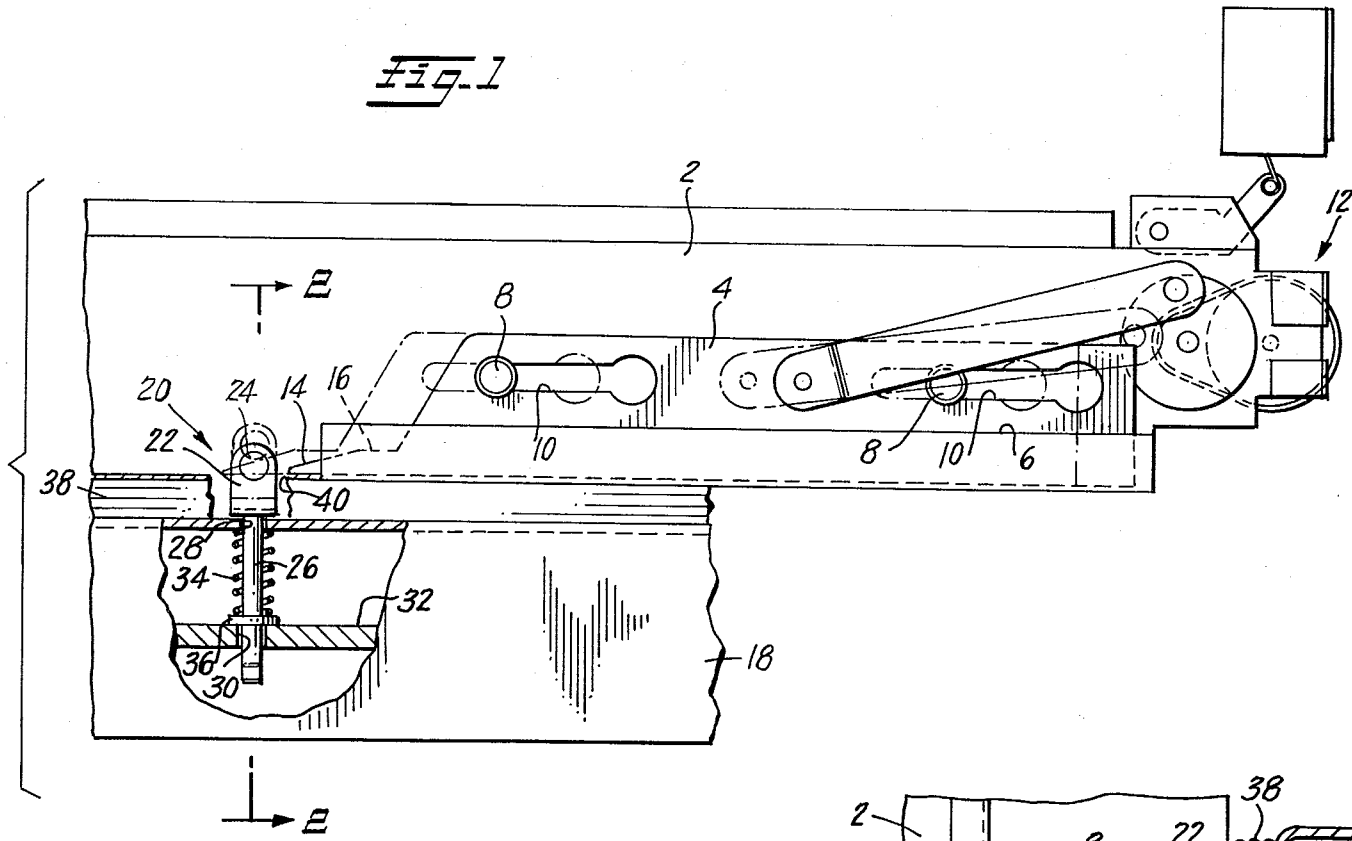
FIG. 1 is a fragmentary view partially broken away showing the mechanism of the present invention.
Figure 2:
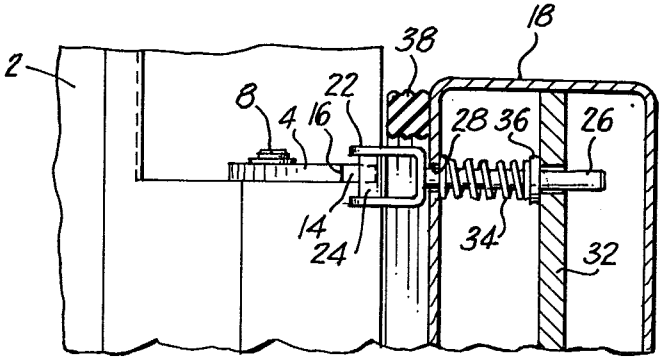
FIG. 2 is a transverse sectional view taken along the line 2—2 of FIG. 1.

In the drawings, numeral 2 designates a fragmentary portion of a range frame, particularly the upper portion extending over the upper opening of the oven compartment. Within the frame portion 2, there is a slidable bolt 4 guided by pin and slot arrangements 8–10.

As shown in the drawings, the bolt 4 is actuated by a motor mechanism designated generally at 12. However, it is to be understood that any suitable bolt moving means could be provided such as a manual lever or otherwise.

The forward or nose portion of the bolt 4 is configured to define a wedge-shaped end 14 and a level or elevated edge portion 16 extending parallel to the direction of movement of the bolt 4.

Numeral 18 designates a fragmentary portion of an oven door, the view thereof being taken from the top looking downwardly, the door being hinged at its bottom edge to the edge of the oven opening, as is conventional. As shown, a keeper 20 is carried by the oven door and consists of a support which may be a yoke portion 22 between the legs of which a roller 24 is journalled. The yoke 22 has a stem 26 fixedly secured thereto, and the stem extends through an opening 28 in the inner wall of the oven door, and through a guide opening 30 in a partition or rib member 32, also within the oven door panel. Surrounding the stem 26 is a compression spring 34 bearing at one end against the inner surface of the inner oven door wall and bearing at its other end against a washer or collar 36 fixedly secured to the stem 26.

Numeral 38 designates a resilient seal carried by either the range or the door itself to extend around the oven door opening when the door is closed and bear resiliently against both the door 18 and the range 2 to provide secure sealing between the door and the range.

The range is provided with a clearance opening 40 on its outer face in position to receive the yoke 22 and roller 24 of the door keeper 20 when the door 18 is closed. At this time, the spring 34 holds the yoke against the inner face of the oven door and the roller 24 is positioned within the range frame where it can be engaged by the bolt 4 when the latter is slid laterally of the oven. Upon thus sliding the bolt 4 laterally, that is, to the left as seen in FIG. 1, the wedge portion 14 engages under the roller 24 and further movement urges the roller 24 and keeper inwardly of the range, thus compressing the spring 34. At this time, the door is held resiliently in tightly closed position exerting pressure throughout the extent of the seal 38.

While a single specific embodiment of the invention has been shown and described herein, the same is merely illustrative of the principles involved and other forms may be resorted to within the scope of the appended claims.

We claim

1. In a range having an oven opening and a hinged door arranged to close said opening:

a bolt member slidably mounted on said range for movement along an edge of said opening;

a keeper on said door projectable into the path of movement of an end of said bolt when said door is closed;

said end of said bolt being of wedge shape to engage and urge said keeper inwardly; and said keeper being resiliently mounted on said door for yieldable inward movement thereon when engaged by said wedge-shaped end of said bolt.

2. A range as defined in claim 1 wherein said keeper comprises a roller and spring means yieldably urging said roller toward said door.

3. A range as defined in claim 2 wherein said end of said bolt comprises said wedge-shaped end sloping inwardly of said opening and a further portion parallel to said opening whereby movement of said bolt causes said roller to ride up said wedge-shaped portion.

4. A range as defined in claim 1 including a sealing member between said door and range around said opening, said resiliently mounted keeper serving to maintain sealing pressure on said sealing member when said door is closed and said keeper held inwardly by said bolt.

* * * * *